US007712609B2

(12) United States Patent
Brown et al.

(10) Patent No.: US 7,712,609 B2
(45) Date of Patent: May 11, 2010

(54) SPRING BIASED CANISTER FOR TOILET BRUSH OR PLUNGER

(75) Inventors: Keith DeLawrence Brown, Montclair, NJ (US); Allen Zadeh, New York, NY (US); Antonio Carlo Hernandez Celestin, New York, NY (US)

(73) Assignee: Helen of Troy Limited, St. Michael (BB)

( * ) Notice: Subject to any disclaimer, the term of this patent is extended or adjusted under 35 U.S.C. 154(b) by 1121 days.

(21) Appl. No.: 10/919,638

(22) Filed: Aug. 17, 2004

(65) Prior Publication Data

US 2006/0037878 A1 Feb. 23, 2006

(51) Int. Cl.
*B65D 43/26* (2006.01)
*B65D 85/00* (2006.01)
*A45D 44/18* (2006.01)

(52) U.S. Cl. ..... 206/361; 206/15.3; 220/826

(58) Field of Classification Search ..... 206/361, 206/362.2, 362.3, 15.2, 15.3, 368, 394, 209, 206/209.1, 249–251, 823, 581, 804; 220/832, 220/826, 326, 831, 23.89, 23.87, 23.91, 23.86, 220/23.83, 529, 6, 833, 836, 822, 823, 824, 220/829, 830, 844, 262–264; 312/207, 206; 248/346.03, 346.06, 523
See application file for complete search history.

(56) References Cited

U.S. PATENT DOCUMENTS 1,281,607 A * 10/1918 Lotka ..... 206/251
1,957,293 A * 5/1934 Reilly ..... 206/250
2,275,549 A 3/1942 Oshman et al.
2,316,979 A * 4/1943 Shipley ..... 206/1.5
2,507,342 A 5/1950 Licari et al.
2,600,345 A 6/1952 Venditti
2,757,787 A * 8/1956 Sergent ..... 206/361
4,456,141 A * 6/1984 Pamment ..... 220/254.5
4,638,910 A * 1/1987 Bokmiller ..... 206/15.2
4,779,753 A * 10/1988 Capy ..... 220/522
D298,712 S 11/1988 Mattei
D315,269 S 3/1991 Brazis
5,170,904 A * 12/1992 Neuhaus ..... 220/262
5,511,807 A * 4/1996 Snyder ..... 280/47.26
5,894,950 A * 4/1999 Kick ..... 220/268
5,924,566 A 7/1999 Gibbs
5,958,150 A 9/1999 Borger et al.
6,457,583 B1 10/2002 Tee et al.
D477,483 S 7/2003 Brown et al.
6,601,700 B1 * 8/2003 Rudnick et al. ..... 206/349
6,837,393 B1 * 1/2005 Kuo ..... 220/263
6,927,137 B2 * 8/2005 Chakravarthi et al. ..... 438/289
7,086,550 B2 * 8/2006 Yang et al. ..... 220/263

* cited by examiner

*Primary Examiner*—Mickey Yu
*Assistant Examiner*—Steven A. Reynolds
(74) *Attorney, Agent, or Firm*—Seyfarth Shaw LLP

(57) ABSTRACT

A canister for housing a tool such as a toilet brush or plunger and the canister has a pair of walls which pivot between an open and closed position via actuation of a platform which moves vertically within the canister upon receipt or removal of the tool therefrom. An actuator is provided to actuate the walls and a bias member may retain the walls in an open position when the tool is removed from the canister.

4 Claims, 7 Drawing Sheets

SPRING BIASED CANISTER FOR TOILET BRUSH OR PLUNGER

The present invention pertains to a canister for housing tools, such as a toilet brush or toilet plunger.

BACKGROUND

Canisters for housing toilet brushes or toilet plungers are known which have a clamshell construction, including a pair of walls which move between an open and a closed position. The canister is generally composed of three parts: a base and a pair of walls mounted on the base. Each wall is pivotally mounted on the base. Each wall has a bottom member that extends perpendicular to the wall and each bottom member overlaps one another. When a tool, such as a toilet plunger or toilet brush, is placed between the walls and is placed onto the bottom members, the weight of the tool on the bottom members causes them to be depressed downward, which in turn causes the walls to move from the open to the closed position. The tool is then enclosed within the canister and the walls surround the base of the tool, such as the brush portion or plunger portion of the tool, and the handle protrudes up through an opening formed in the top of the walls.

The use of overlapping base members, operates effectively in order to move the walls to the closed position. However, such canisters sometimes do not close completely or the walls do not line up with each other and gaps may appear between the edges of the walls. As well, such canisters can not be locked or maintained in the open position and extra effort may be required in order to insert the tool within the canister because it has closed. For example, removal of the tool from the canister by pulling up on the handle of the tool causes the brush portion or plunger end to abut against the interior of the walls and causes the walls to move to the open position. However, while the tool is separated from the canister to clean or unclog a toilet, it is possible for the walls of the canister to close. Because the canister does not have a mechanism to retain the walls in the open position, an inadvertent bump against one of the walls can cause the walls to close. Therefore, when returning to the canister with the tool, it cannot be placed quickly and easily inside the open canister. It is necessary for the user to bend down, grab the walls with his or her hands and spread them apart manually to the open position prior to inserting the tool therein. As the canister may be dirty or covered with germs or other matter, it may be undesirable for the canister walls to be touched by a user's hand. Therefore, the inadvertent closing of the walls of the canister while the tool is removed is very undesirable. A canister that overcomes these disadvantages and that can be quickly and inexpensively manufactured is desirable.

SUMMARY OF THE INVENTION

The present invention provides for a canister comprising a base, a wall attached to the base and moveable between a first and second position, a platform bias mounted on the base and an actuator disposed between the wall and the platform so that upon movement of the platform the wall is moved between the first and the second position and between the second and the first position. In an embodiment, the platform may be provided in a first condition biased upwardly from the base and the platform may be shaped to receive a tool thereon and placement of the tool on the platform may cause the platform to be depressed to a second condition and to actuate the wall to move from the first position to the second position. In an embodiment, upon removal of the tool, the platform may be biased upward to the first condition in order to actuate the wall to move from the second position to the first position. In an embodiment, the actuator may include a flange and a pivot member, the flange may be attached to the platform and the pivot member may protrude from the wall connected to the flange so that upon movement of the platform the pivot member may be displaced within the flange in order to move the wall between the first and second position.

In an embodiment, the platform may be mounted on a bias member in order to move the platform between a first condition where the platform is biased upward and elevated above the base and a second condition where the platform is depressed and disposed adjacent the base. In an embodiment, a pair of walls are hingedly attached to the base and a tool may be mounted on the platform and pushes the platform downward to the second condition so that the walls are in the first position and a portion of the tool is enclosed within the walls of the canister. In an embodiment, the flange may include a slot and the pivot member may include a rod that rides in the slot between a first end and second end of the slot. When the platform is in the first condition the rod may be located at the first end of the slot and when the platform is in the second condition the rod may be located at the second end. The translation of the rod between the first and second ends, may cause the walls to pivot between the first and second positions.

In an embodiment, the base may include a cup and a spring may be mounted in the cup and bias the platform. In an embodiment, the platform may include a boss on the bottom for receiving the spring, so that the spring is disposed between the boss of the platform and a cup on the base. In an embodiment, the platform may include a pair of flanges disposed on each side and each flange may include a slot for receiving the rods. In an embodiment, the canister may have a central axis and the platform may be biased vertically along the central axis. In an embodiment, the slots may be oriented perpendicular to the central axis. In an embodiment, each side of the platform may include a pair of flanges, each having a slot.

In an embodiment, each pivot member may include a rod having exposed ends and the ends received in the slots of each pair of flanges. In an embodiment, the platform is generally cylindrical and includes a central receptacle for receiving a working end of a tool therein and the base may include an outer wall surrounding the receptacle. In an embodiment, the wall may include an opening through which the pivot member is received. In an embodiment, a pair of flanges may be disposed generally between the receptacle and the outer wall may have one of the flanges disposed generally on each side of the opening. In an embodiment, the base may include retention fingers for receiving a pivot structure of each wall for pivotally mounting the wall thereto. In an embodiment, the base may include a column for receiving a tab protruding from the platform, wherein the column and tab radially align the platform to the base. In an embodiment, the base may include a ring disposed about its bottom perimeter.

In another embodiment, the invention provides for a method of operating a canister for housing a tool comprising the steps of providing a canister having a pair of walls and a platform bias mounted therein, inserting an end of the tool between the pair of walls, placing the end of the tool on the platform, actuating the platform via the weight of the tool applying a downward force on the platform, pivoting the walls from an open position to a closed position in order to enclose the end of the tool, lifting the tool so that it is not resting on the platform, pushing the platform upward via the bias member mounted under the platform and pivoting the walls from the closed to the open position via the platform's movement upward. In an embodiment, the method may further comprise the steps of providing an actuator having a flange for receiving rods protruding from the walls for translating vertical movement of the platform via the actuator to arcing movement of the rod traveling on the flange and pivoting the wall. In an embodiment, the method may further comprise the step of maintaining the walls in an open position via the bias force of the bias member pushing the platform upward until a tool is placed on the platform in order to counteract the bias force.

In a further embodiment, the invention provides for a method of assembling a canister comprising the steps of providing a platform having a flange, a bias member, a base having retention fingers and a wall having a pivot structure and a pivot member, attaching the pivot structure of the wall to the retention fingers of the base so that the wall pivots on the base, mounting the bias member to the base, mounting the platform to the base so that the platform is supported by the bias member and attaching the flange to the pivot member so that vertical movement of the platform is translated to pivotal movement of the pivot member and the wall. In an embodiment, the method may further comprise the steps of providing a rod protruding from the pivot member and a slot on the flange and inserting the rod in the slot so that the rod slides between a first end of the slot when the platform is depressed and a second end of the slot when the platform is elevated.

Another embodiment of the invention provides for a canister comprising a base, an actuator bias mounted to the base and a closer member attached to the actuator and biased in an open position and the closer member may be movable away incrementally from the open position, but the actuator automatically biases the closer member back to the open position. In an embodiment, a bias member may be mounted to the base and biases the actuator. In an embodiment, the closer member may be movable from the open position to a closed position and upon application of a force against the bias member, the closer member can remain in the closed position. In an embodiment, a platform may be disposed in the canister and the actuator is attached to the platform. In an embodiment, the closer member may include a wall pivotally mounted to the base.

BRIEF DESCRIPTION OF THE DRAWINGS

For the purpose of facilitating an understanding of the subject matter sought to be protected, there are illustrated in the accompanied drawings, embodiments thereof, from an inspection of which, when considered in connection with the following description, the subject matter sought to be protected, its construction and operation, and many of its advantages should be readily understood and appreciated.

DETAILED DESCRIPTION

Figure 1:
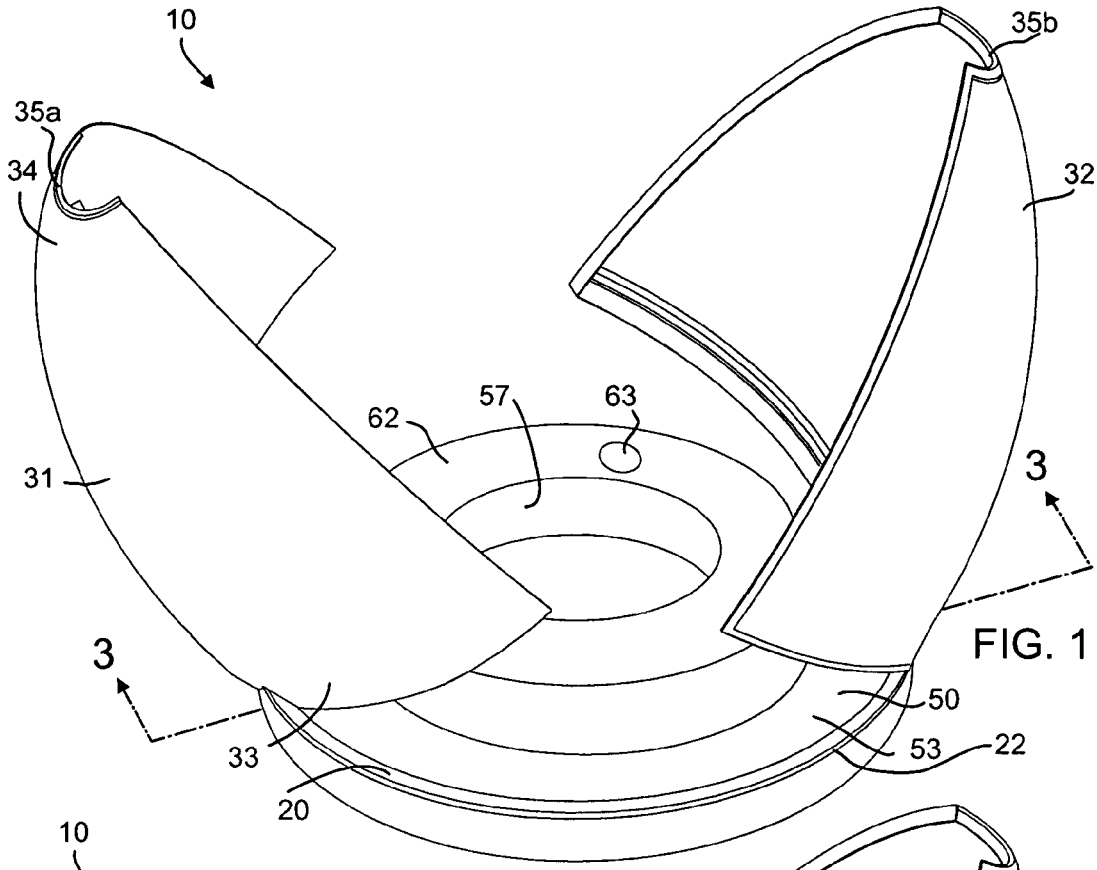
FIG. 1 is a perspective view of a plunger canister embodiment of the present invention in an open position.
Figure 2:
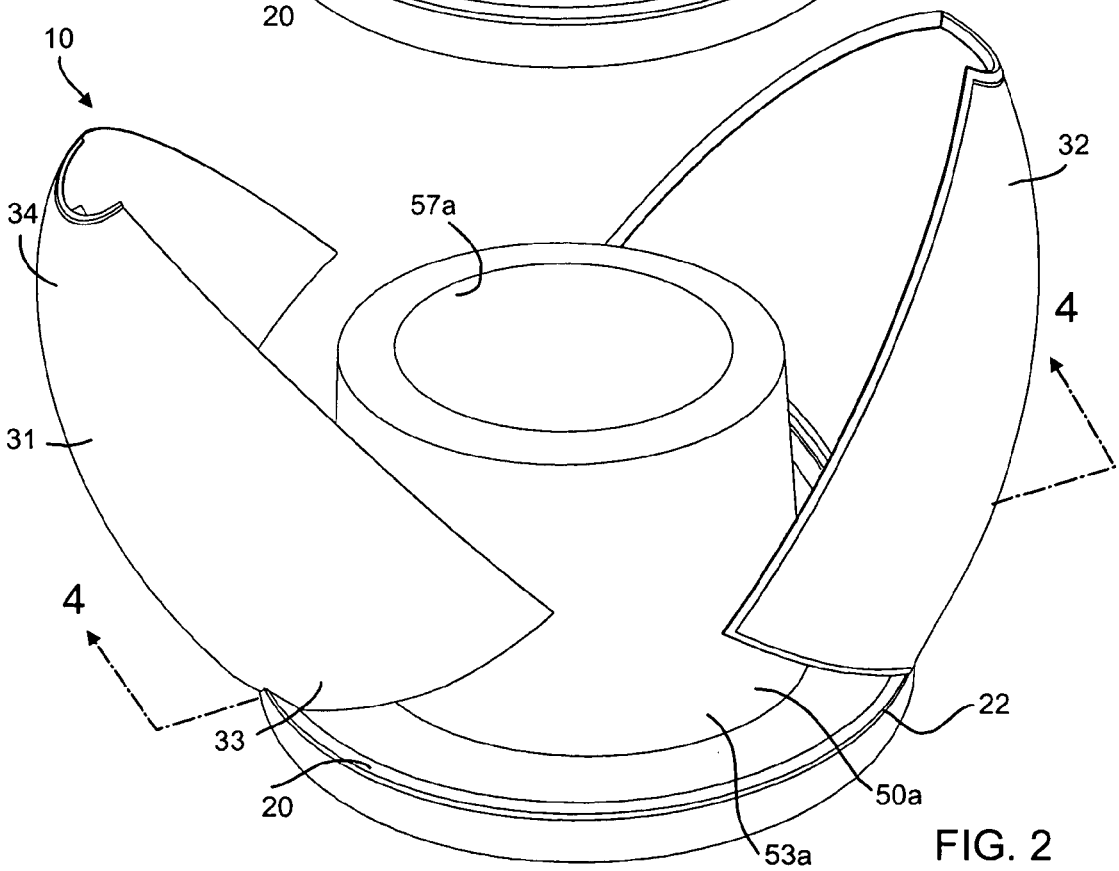
FIG. 2 is a perspective view of a toilet brush canister embodiment of the present invention in an open position.
Figure 3:
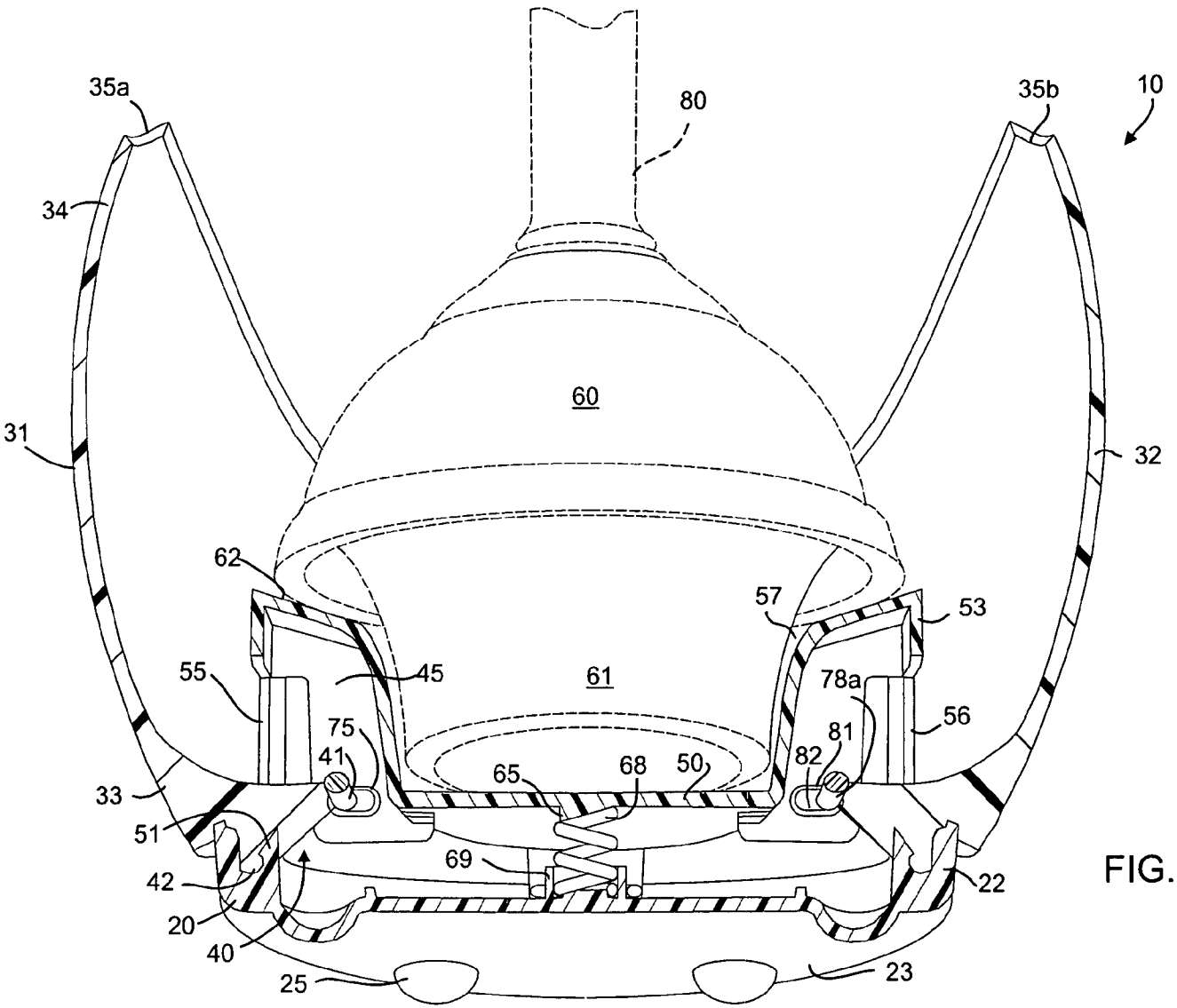
FIG. 3 is a sectional view of the canister of FIG. 1 taken at line 3-3.
Figure 4:
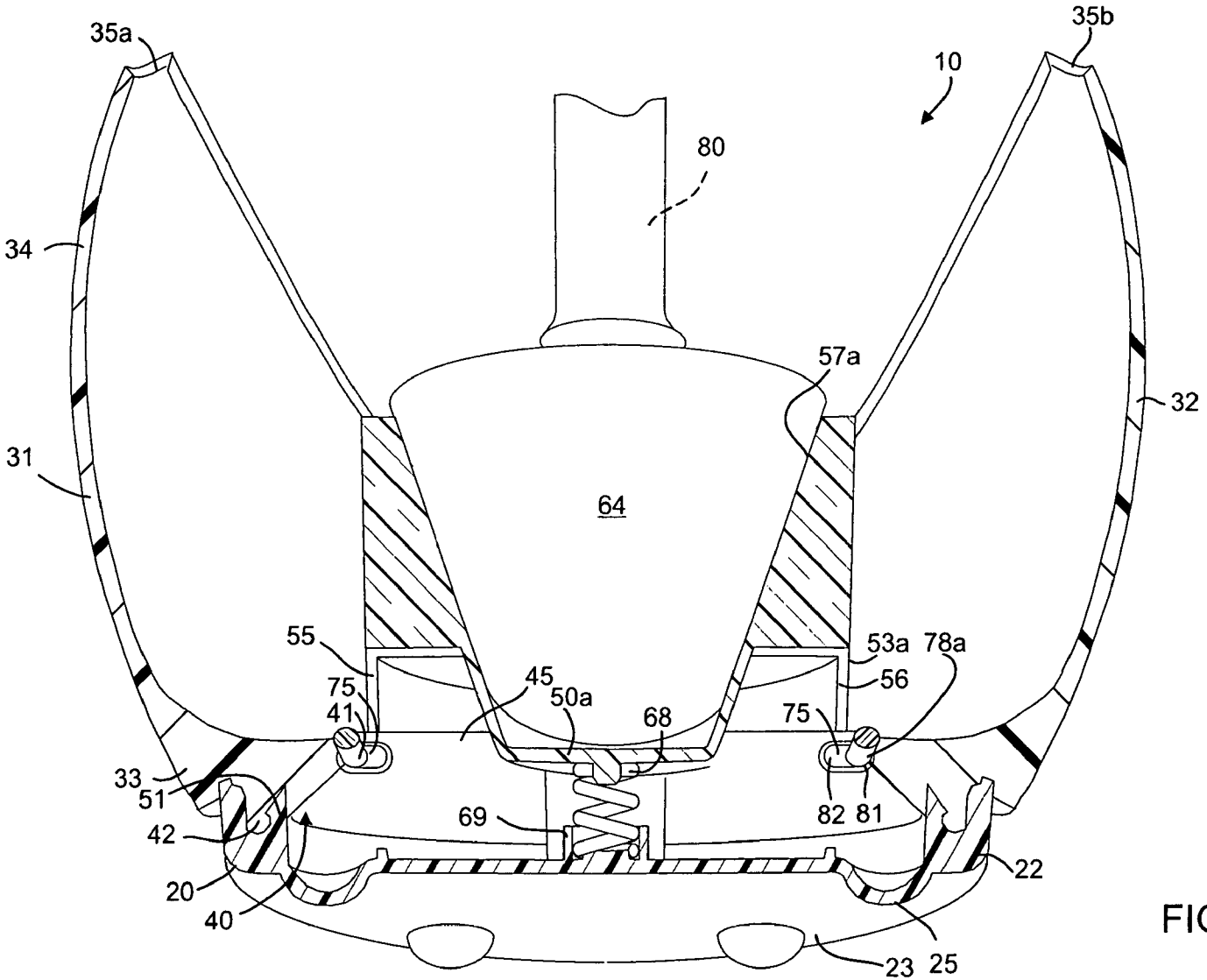
FIG. 4 is a sectional view of the canister of FIG. 2 taken at line 4-4.

The present invention is described with respect to embodiments depicted in FIGS. 1-8. FIGS. 1, 3 and 5-8 depict an embodiment for receiving and housing a toilet plunger. FIGS. 2 and 4 depict an embodiment for housing a toilet brush. However, it is to be understood that the present invention may be used for housing other devices such as other tools used around a household or any other item which has a handle protruding from a working end of the tool which is desired to be housed within a canister. While the figures may depict an embodiment either for housing a plunger or a brush, like numerals will be used for like elements in each embodiment.

The canister 10 includes a base 20. In an embodiment, the base 20 is cylindrical and includes an annular rim 22 and a bottom 23. In an embodiment, pads 25 are disposed around the bottom 23 and help to stabilize the base 20 when placed on a flat surface such as a floor. A pair of closer members or walls 31, 32 are pivotally mounted to the base 20. Although the embodiment depicted includes a pair of walls 31, 32, the present invention may also have more than two walls. It is to be understood that the mechanism of the present invention could be adapted to operate for a canister 10 having two or more walls or closer members. As depicted, the walls are generally arcuate-shaped and when the walls are joined together in the closed position (FIGS. 7 and 8), the walls form a generally parabaloid shape. Such a parabaloid shape is convenient in that it allows for a generally dome-shaped plunger or brush to be housed therein. However, in an alternate embodiment the shape of the walls 31, 32 may be formed to more closely correspond to the shape of the tool to be placed therein. In an alternate embodiment, the walls 31, 32 may be polygonal in shape and/or not correspond to the tool placed therein. Each wall includes a lower portion 33 and an upper portion 34. Each wall 31, 32 has at its upper portion 34 a semicircular neck 35*a*, 35*b*. When the walls 31, 32 are in a closed position, the semicircles 35*a*, 35*b* abut one another and form a circular hole 35 through which a handle 80 of the tool may protrude. In an alternate embodiment, any shape hole 35 may be provided upon the closing of the walls 31, 32.

Disposed adjacent the lower portion 33 of each wall 31, 32 is an actuator 40. In an embodiment, the actuator 40 includes a pivot member 41 and a pivot structure 42. The actuator 40 may further comprise a flange 45. The actuator 40 acts to pivot the walls 31, 32 upon activation via a platform 50. In an embodiment, the pivot structure 42 is a semicircular-shaped tab that is received by retention fingers 51 formed in the annular rim 22 of the base 20. In an embodiment, three retention fingers 51 are provided at each side of the base 20, for example in the twelve o'clock and six o'clock positions (see FIG. 5). In an embodiment, a pair of pivot structures 42 are provided on each actuator 40 and are received by the retention fingers 51. In an embodiment, the retention fingers 51 and pivot structure 42 are precision molded so that the semicircular tabs 42 may be snap fit into the retention fingers 51 and provide a pivoting connection of the wall 31, 32 to the base 20. However, it is to be understood that any hinge type mechanism may be provided in order to attach the wall 31, 32 to the base 20. The pivot member 41 of the actuator 40 will be described in more detail below.

A platform 50, 50*a* is mounted to the base 20. The platform 50, 50*a* is generally cylindrical and is shaped to receive a tool 60, 64 therein. As shown in FIGS. 1, 3 and 5-8, the platform 50 is shaped to receive a plunger 60 therein. The platform 50 includes a central receptacle 57, 57*a* and an outer wall 53, 53*a*. Each wall 53 has a pair of openings 55, 56. In an embodiment, the first opening 55 is at the twelve o'clock position and the second opening 56 is at a six o'clock position. Each opening 55, 56 exposes a flange 45 disposed therein (see FIG. 6). In an embodiment, a pair of flanges 45 are disposed within each opening 55, 56 at each side of the openings 55, 56. The overall shape of the platform 50, 50*a* including the receptacle 57, bottom 58 and outer wall 53 are shaped to conform to the tool 60, 64 placed therein. As depicted in FIGS. 1, 3 5 and 8 the receptacle 57 has a diameter slightly larger than the outer diameter of the working end 61 of the plunger 60, so that it may be securely mounted onto the platform 50. An upper rim 62 is also shaped corresponding to the protruding annular rim of the plunger 60 and includes protrusions 63 in order to stabilize it on the platform 50.

As depicted in FIGS. 2 and 4 the platform 50*a* is shaped so that its receptacle 57*a* is slightly larger than the brush 64 to be received therein. For example the receptacle 57*a* may be frustroconical in shape in order to receive the frustroconically-shaped brush end 64 of a toilet brush. In an alternate embodiment, the shape of the platform 50, 50*a* and its receptacle 57, 57*a* may be formed in any shape in order to correspond with the shape of the working end of a tool to be inserted therein.

Figure 5:
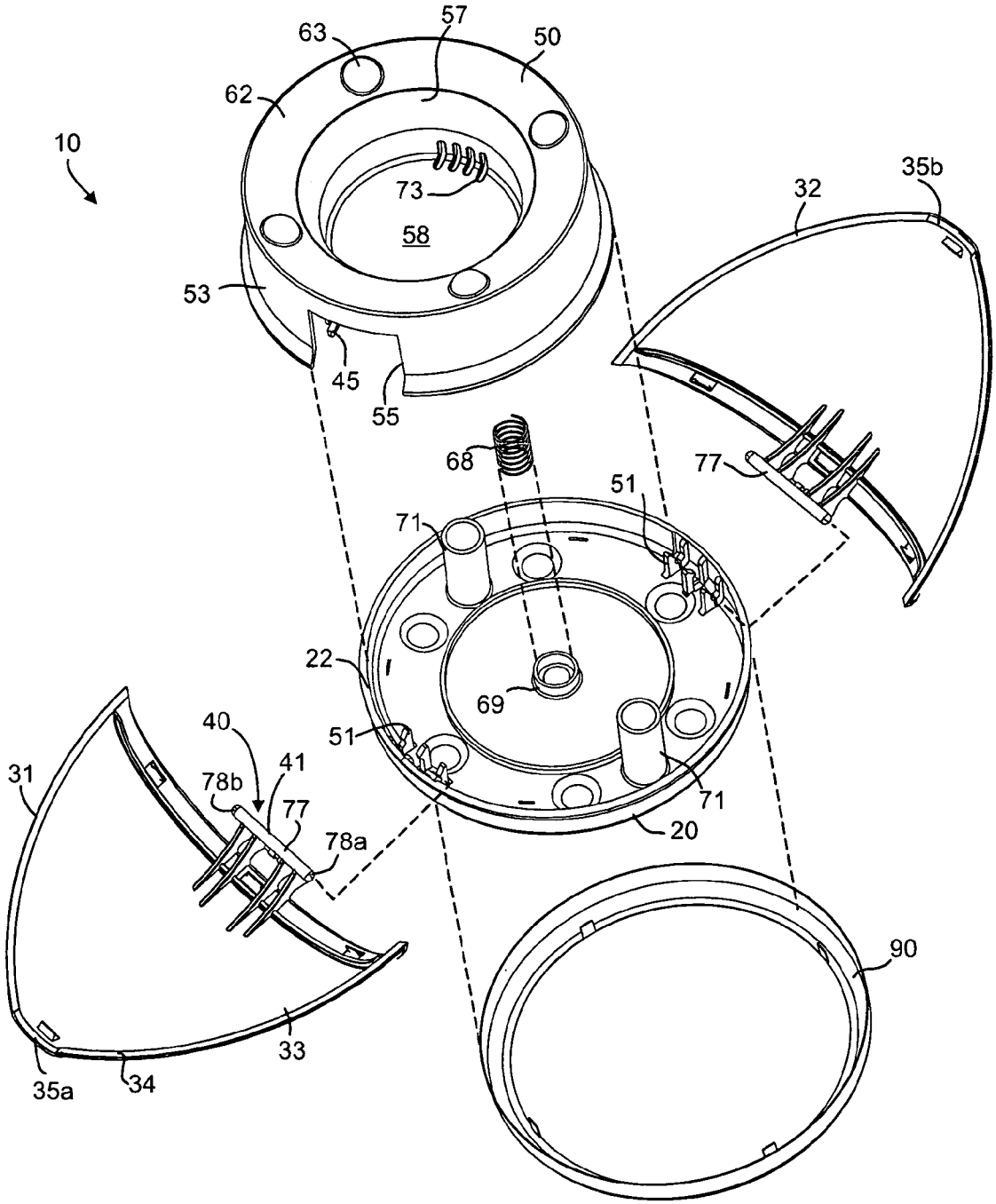
FIG. 5 is an exploded perspective top view of the canister of FIG. 1.

The platform 50 in an embodiment, includes a boss 65 (see FIG. 6) for receiving a bias member such as a coil spring 68. The spring 68 is received in a cup 69 formed on the base 20 (FIG. 5). The spring 68 is disposed between the cup 69 and the boss 65 and biases the platform on the base 20. In an alternate embodiment, the bias member 68 may be any known mechanical means for biasing such as a living hinge, resilient or ring, spring arm, etc. The bias member 68, in an alternate embodiment, may also directly bias the actuator 40 or the walls 31, 32. In an embodiment, the longitudinal axis of the spring 68 is aligned with the central axis of the platform 50 and the base 20. As well the walls 31, 32 are attached to the base 20 so that the hole 35 is also aligned with the central axis. Therefore, upon placement of the tool 60, 64 on the platform 50, 50*a* the handle 80 of the tool will be aligned with the central axis and protrude through the hole 35.

Figure 6:
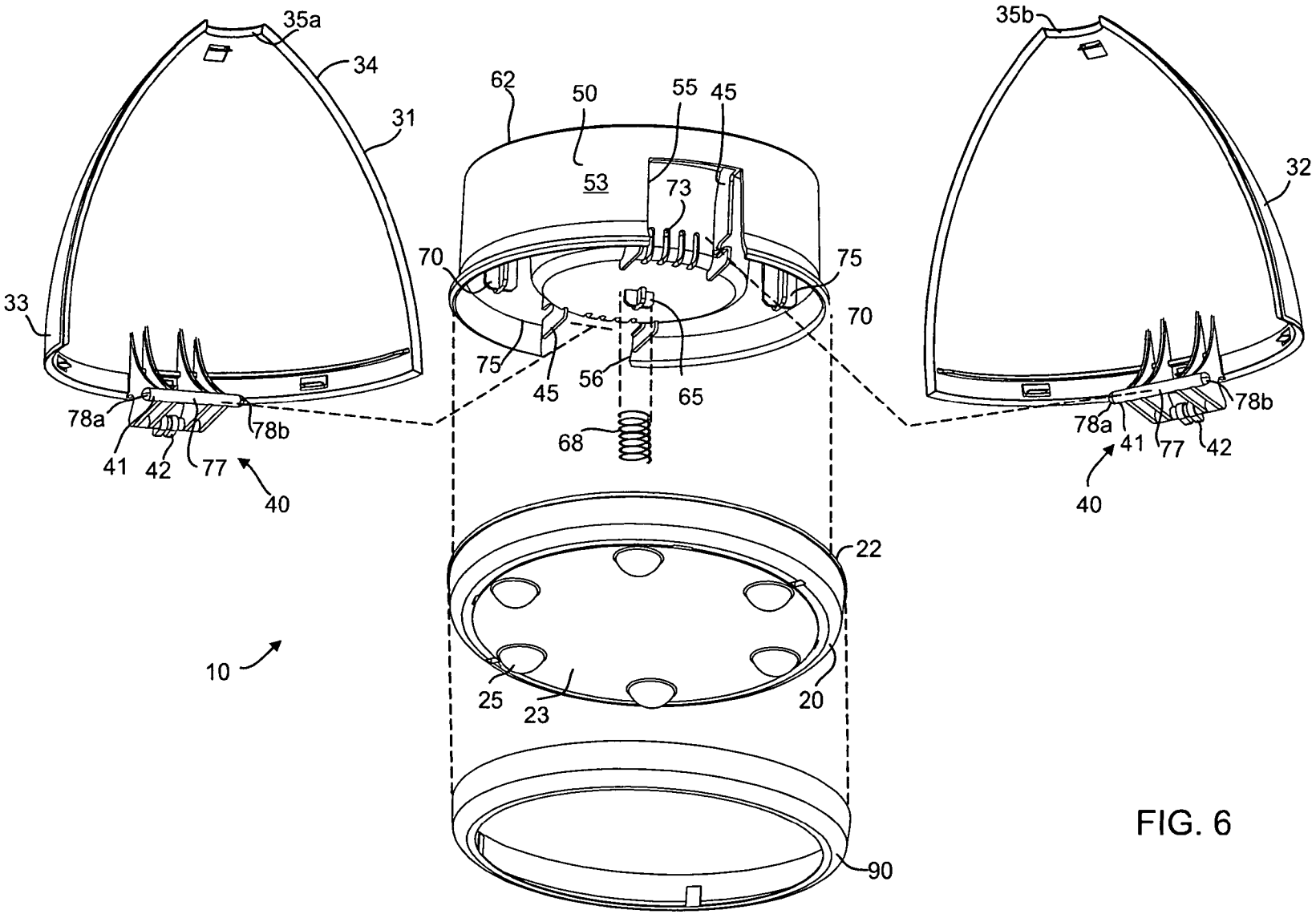
FIG. 6 is an exploded bottom perspective view of the canister of FIG. 1.
Figure 8:
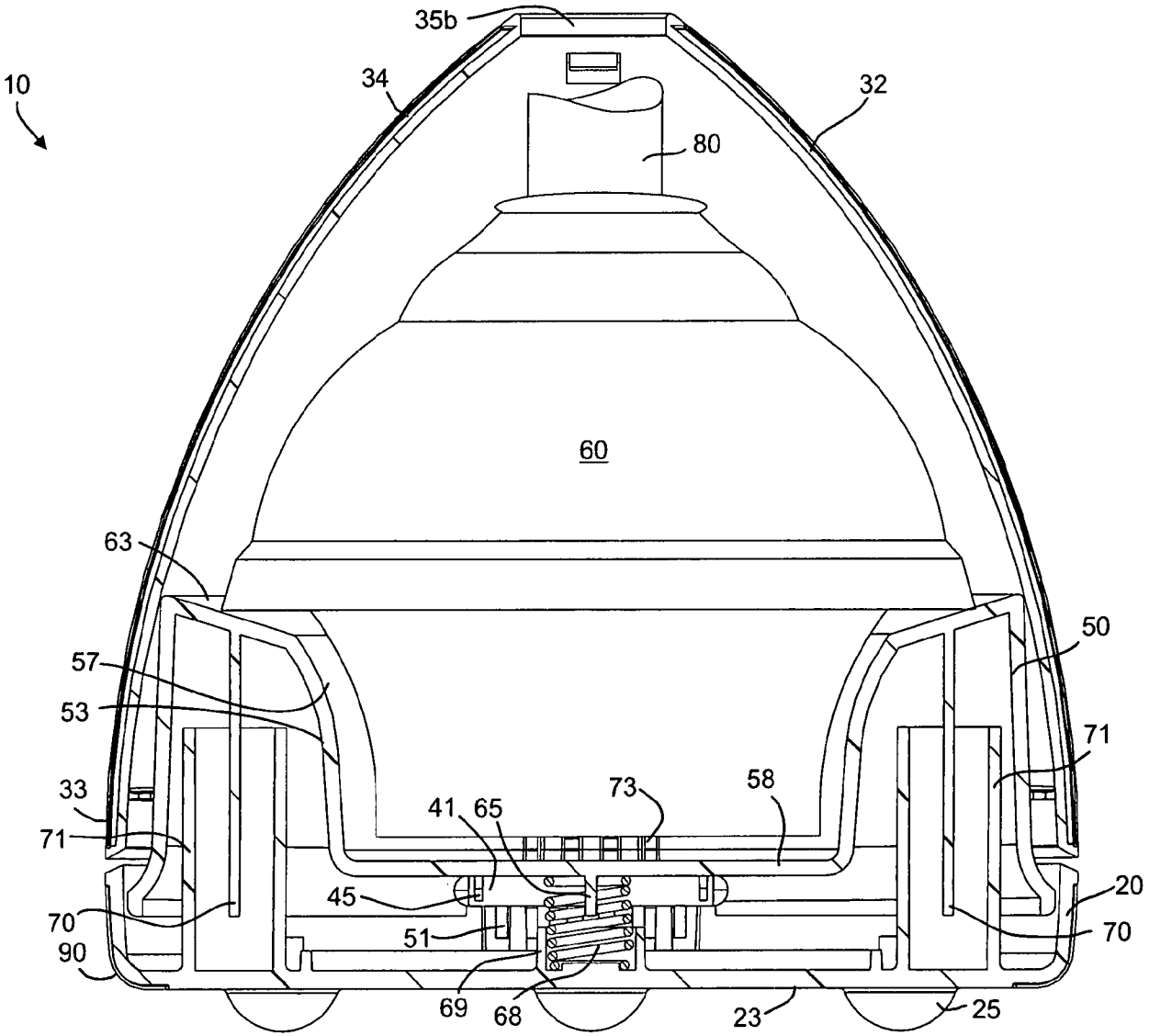
FIG. 8 is a sectional view of the canister of FIG. 7 taken at line 8-8.

In an embodiment, the platform 50 includes tabs 70 that are received within columns 71 protruding upward from the base 20 (see FIGS. 5, 6 and 8). The alignment of the tabs 70 and columns 71 radially aligns the platform 50 to the base 20 in order that the flanges 45 and openings 55 of the platform 50 are aligned to the retention fingers 51 of the base 20. Such an orientation allows the actuator 40 to be mounted so that its pivot structure 42 is mounted to the retention fingers 51, the actuator 40 is received through the openings 55, 56 and the pivot member 41 may engage the flanges 45 of the platform 50. The receptacle 57 may include drain slits 73.

As discussed above, the platform 50, 50*a* includes at least one flange 45. In an embodiment, a pair of flanges 45 are provided on each side. Each flange includes a slot 75 (see FIG. 6) adjacent the openings 55, 56. Each slot 75 is generally oval-shaped and extends perpendicular to the central axis of the platform 50. The slot 75 receives the pivot member 41 therein. In an embodiment, the pivot member is a rod 77 disposed so that it has a pair of free ends 78*a*, 78*b*. The free ends 78*a*, 78*b* are received in the slots 75 oriented at each end of the rod 77. Each slot 75 includes a first end 81 and a second end 82. The rod 77 translates between the first end 81 and second end 82 of the slot 75. As shown in FIGS. 3 and 4, when the free end 78*a* of the rod 77 is received at the first end 81 of the slot 75, the walls 31, 32 will be pivoted outwardly to an open or first position. The actuator 40, in an alternate embodiment, may actuate the walls 31, 32 via other known mechanisms. For example, the flanges 45 may be located on the walls 31, 32 and the pivot member 41 may be located on the platform 50.

Figure 7:
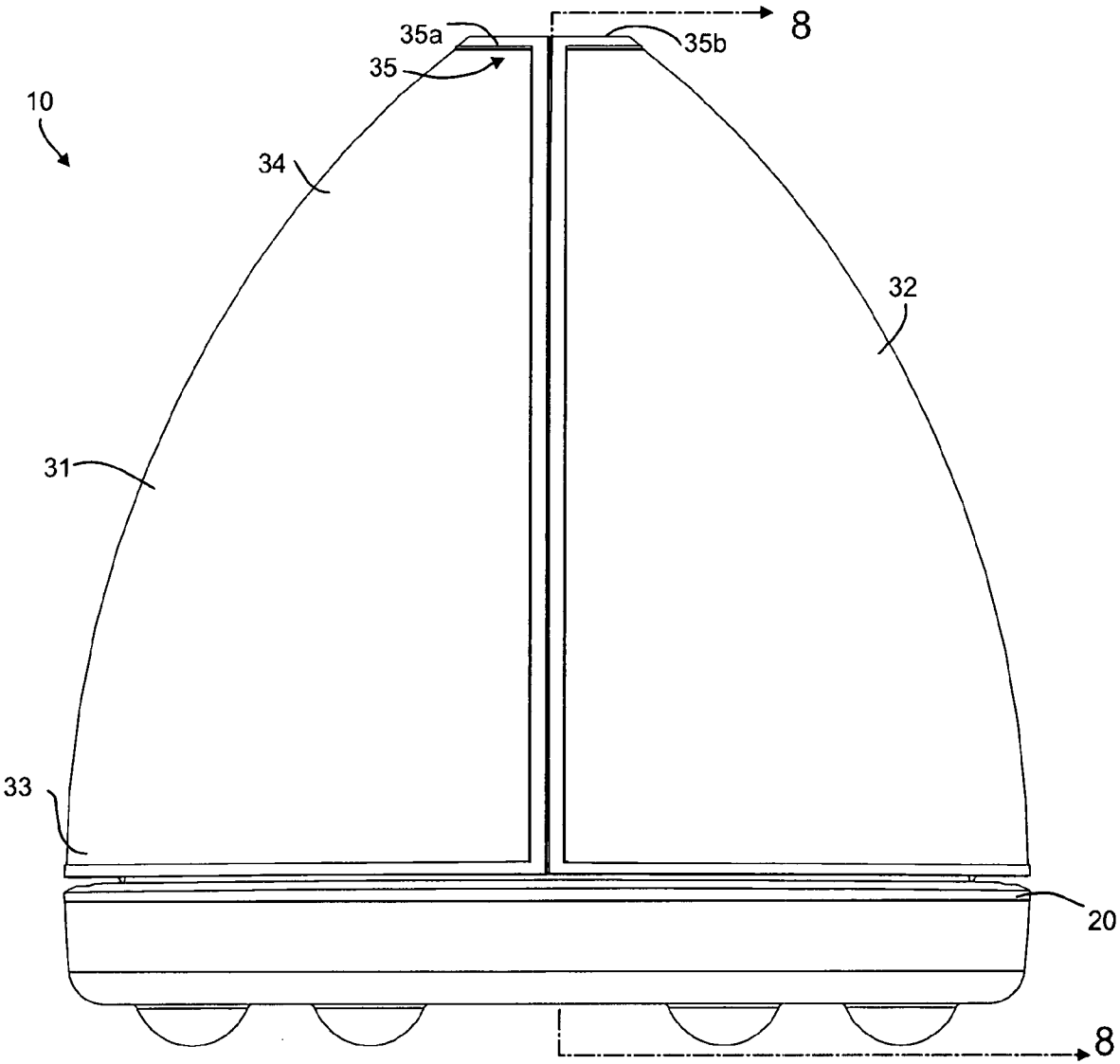
FIG. 7 is a side elevation view of the canister of FIG. 1 in a closed position.

Operation of the canister 10 proceeds by actuating the walls from an open position, as depicted in FIGS. 1-4, to a closed or second position, as depicted in FIGS. 7 and 8. The open position is the position that the canister 10 remains in when a tool is not inserted within the canister 10, as shown in FIGS. 1 and 2. A tool, such as a plunger 60 or brush 64, is inserted between the walls 31, 32. Prior to placement of the tool onto the platform 50, as depicted in FIGS. 3 and 4, the walls 31, 32 will continue to be in the open position because the platform 50 is biased by the spring 68. When the tool is released from a user's hand, the weight of the tool will push downward on the platform 50 as shown in FIG. 8. The spring 68 will have a predetermined bias rate, to allow for compression of the spring 68 upon receipt of the weight of the tool thereon. In an embodiment, the canister 10 and tool 60, 64 can be designed, assembled and sold as a package. Thus, the weight of the tool 60, 64 can be predetermined and the bias rate of the spring 68 can be carefully selected in a predetermined manner. Upon release of the tool 60, 64 downward onto the platform 50, the spring 68 will compress and the platform 50 will move downward toward the base 20 to a second condition.

Upon movement of the platform 50 downwardly, the rods 77 will be translated from the first end 81 to the second end 82 of the slots 75. The vertical movement of the platform 50, flanges 45 and slots 75 downward causes the rod 77 to move in an arc toward the base 20. The arrangement of the actuator 40 having the pivot member 41 extended from the pivot structure 42 causes the wall 31, 32 to pivot inwardly toward a closed or second position, as depicted in FIG. 7 and FIG. 8. When the tool 60 rests on the platform 50, the platform 50 is lowered downward so that it is generally abutting the base 20 and the spring 68 is completely compressed in the first condition (see FIG. 8). In the closed position, the tool 60 is enclosed within the closed walls 31, 32 of the canister 10.

The operation of the canister continues by removal of the tool 60, 64 from the canister 10. Upon gripping of the handle 80, the tool 60, 64 is pulled in an upward direction along the central axis, so that its weight is lifted from the platform 50 as shown in FIGS. 3 and 4. Upon lifting of the weight from the platform 50, the spring 68 will bias the platform upwardly along the central axis. The bias force of the spring 68 pushes the platform 50 upward to a first condition (see FIGS. 3, 4) and causes the flanges 45 to move upward which causes the rods 77 to translate from the second end 82 to the first end 81 of the slots 75. The translation of the rods 77 causes the walls 31, 32 to pivot outwardly to the open position. Thus, further movement of the working end 61 of the tool upward is not needed in order to open the canister, for example by the working end 61 abutting against the interior of the walls 31, 32.

Once the tool 60, 64 is completely removed from between the walls 31, 32, the canister 10 will remain in the open position. Because the spring 68 continues to bias the platform 50 upwardly, the walls will continue to be pivoted outwardly as depicted in FIGS. 1 and 2. Therefore, while the tool 60, 64 is being used, such as to clean a toilet using a toilet brush 64 or to unclog a toilet using a plunger 60, the canister 10 remains in the open position. Even if the wall 31, 32 were to be struck or bumped by a user's foot toward the closed position, the walls 31, 32 will be biased automatically outward and return to the open position.

In an embodiment, the canister may be assembled by the following steps. In an embodiment, each of the components of the canister 10 may be injection molded of a hard polymer material. A ring 90 is placed onto the base 20. Each of the walls 31, 32 are attached to the base 20 by inserting the pivot structure 42 into the retention fingers 51. In an embodiment, the pivot structure 42 may be snap-fit between the retention fingers 51. The spring 68 may then be mounted into the cup 69. The platform 50 is then placed onto the base 20 so that the bar 65 is aligned with the spring 68 and the tabs 70 are aligned with the columns 71. Such alignment provides for the actuator 40 to be aligned with the openings 55, 56 and the actuator 40 protrudes within the openings 55, 56 so that the rods 77 may be aligned with the slot 75 and inserted into the slots 75. Therefore, it can be understood that the canister 10, may be simply and quickly assembled. In order to package or ship the canister 10, an adhesive decal or tape may be placed on each side of the walls 31, 32 to adhere the walls 31, 32 in their closed position. Upon receipt by the end user, the adhesive may be removed so that the canister 10 maintains its open position until a tool 60, 64 is inserted therein. Alternatively, the canister 10 may be packaged and shipped with a tool 60, 64 housed therein in the closed position.

The matter set forth in the foregoing description and accompanying drawings is offered by way of illustration only and is not as a limitation a limitation. While particular embodiments have been shown and described, it would be obvious to those skilled in the art that changes and modifications may be made without departing from the broader aspects of applicant's contribution. The actual scope of protection sought is intended to be defined in the following claims when viewed in their proper perspective based on the prior art.

What is claimed is:

1. A canister comprising:

a base;

a first wall and a second wall each hingedly attached to the base and moveable between a first and second position;

a spring activated platform mounted on the base for movement relative to the base, the platform being located at an interior portion of the canister; and an actuator disposed between at least one of the first and second walls and the platform so that upon movement of the platform, at least one of the first and second walls is moved between the first and the second position, wherein the canister includes a flange and a pivot member, the flange attached to the platform and the pivot member protruding from at least one of the first and second walls and connected to the flange so that upon movement of the platform the pivot member is displaced on the flange in order to move at least one of the first and second walls between the first and second position, wherein the flange includes a slot and the pivot member includes a rod that rides in the slot between a first end and second end of the slot and when the platform is in the first condition the rod is located at the first end of the slot and when the platform is in the second condition the rod is located at the second end of the slot and the translation of the rod between the first and second ends, causes the first and second walls to pivot between the first and second positions.

2. A canister comprising:

a base;

a pair of actuators bias mounted to the base;

a pair of closer members attached to the actuator and biased towards an open position, the closer members being movable away incrementally from the open position; and a platform disposed in the canister, the pair of actuators being attached to the platform, wherein the pair of actuators each includes a pivot member for pivotably attaching the pair of closer members to the base so that the closer members enclose the base, actuator and platform, except for a hole formed when each closer member is in a closed position, the hole configured for receiving a tool handle therethrough, wherein the platform is generally cylindrical in shape, is mounted within the base and includes an outer wall and the pivot member is attached to the base adjacent the outer wall, where the platform includes an upper rim that extends above the base when assembled thereto and the closer members are oriented generally parallel to the outer wall of the platform when oriented in a closed position.

3. The canister of claim 2 wherein the closer members each include a wall pivotably mounted to the base.

4. The canister of claim 2 wherein the platform includes a flange protruding therefrom for engaging the actuator in order to push the closer member to the open position as a result of a spring at the base of the platform biasing it upward.

* * * * *